US008747184B2

(12) United States Patent
Liu

(10) Patent No.: US 8,747,184 B2
(45) Date of Patent: Jun. 10, 2014

(54) SUPPORT STRUCTURE FOR A BRASSIERE

(75) Inventor: Zhenqiang Liu, Kwai Chung (HK)

(73) Assignee: Regina Miracle International (Group) Limited, Hong Kong (HK)

( * ) Notice: Subject to any disclaimer, the term of this patent is extended or adjusted under 35 U.S.C. 154(b) by 404 days.

(21) Appl. No.: 13/089,462

(22) Filed: Apr. 19, 2011

(65) Prior Publication Data

US 2012/0184181 A1 Jul. 19, 2012

Related U.S. Application Data

(63) Continuation-in-part of application No. PCT/CN2011/070227, filed on Jan. 13, 2011.

(51) Int. Cl.
*A41C 3/00* (2006.01)
*A41C 3/12* (2006.01)

(52) U.S. Cl.
CPC ..... *A41C 3/122* (2013.01); *A41C 3/128* (2013.01)
USPC ..... 450/41; 450/47; 450/51; 450/52

(58) Field of Classification Search
USPC ..... 450/39, 41, 45, 47, 51, 52
See application file for complete search history.

(56) References Cited

U.S. PATENT DOCUMENTS

| | | | | |
|---|---|---|---|---|
| 2,782,417 | A * | 2/1957 | Magidson | 450/41 |
| 3,114,374 | A * | 12/1963 | Chalfin et al. | 450/41 |
| 3,605,753 | A * | 9/1971 | Schwartz | 450/52 |
| 5,141,470 | A | 8/1992 | Morgan et al. | 450/52 |
| 5,472,366 | A * | 12/1995 | Moore | 450/41 |
| 6,053,800 | A * | 4/2000 | Lattanzi | 450/41 |
| 6,241,576 | B1 * | 6/2001 | Hofer | 450/41 |
| 6,346,028 | B1 * | 2/2002 | Fildan et al. | 450/41 |
| 6,435,939 | B1 * | 8/2002 | Lin | 450/41 |
| 6,447,365 | B1 * | 9/2002 | Powell et al. | 450/41 |
| 7,112,117 | B2 * | 9/2006 | Horta et al. | 450/41 |
| 7,458,877 | B2 * | 12/2008 | Yu | 450/39 |
| 7,841,924 | B2 * | 11/2010 | Wan | 450/41 |

FOREIGN PATENT DOCUMENTS

| | | | |
|---|---|---|---|
| CN | 2759219 | Y | 2/2006 |
| JP | 8-323890 | A | 12/1996 |
| WO | WO 2012/026831 | A2 | 3/2012 |

OTHER PUBLICATIONS

International Search Report and Written Opinion dated Oct. 20, 2011 issued in corresponding International Application No. PCT/CN2011/070227 (12 pages).

* cited by examiner

*Primary Examiner* — Gloria Hale
(74) *Attorney, Agent, or Firm* — Ostrolenk Faber LLP

(57) ABSTRACT

A support structure for placement in a lower periphery of a breast cup for a brassiere, the support structure including a support component shaped to follow the curve of at least the underside of a wearer's breast, the support component including a first region formed by a first polymer material and a second region formed by a second polymer material, wherein the first polymer material is harder than the second polymer.

24 Claims, 4 Drawing Sheets

SUPPORT STRUCTURE FOR A BRASSIERE

CROSS-REFERENCE TO RELATED APPLICATIONS

This application is a continuation-in-part of a PCT international application number PCT/CN2011/070227, entitled "Improved Support Structure For a Brassiere", filed Jan. 13, 2011, and the complete contents of this application is incorporated herein by reference.

FIELD OF THE INVENTION

The present invention relates generally to support undergarments, namely brassieres and similar undergarment including swimwear. More particularly, the present invention relates to an improved support structure for use in a breast cup in a brassiere. A brassiere incorporating the improved support structure is also provided.

BACKGROUND TO THE INVENTION

A conventional brassiere comprises of a pair of breast cups intended to cover and support the breasts of the wearer, a connector securing together the inner edges of the cups at the wearer's cleavage, and at least one strap-like back or wing that extends from outer edges of the breast cups around the back of the wearer. The brassiere may further include shoulder straps that extend from upper edges of the breast cups over the shoulders of the wearer to attachment points on the strap-like back or wing crossing the wearer's back.

It is also standard to use an underwire to shape and support the lower periphery of each breast cup. An underwire typically consists of a U-shaped frame formed from metal or a rigid plastic material. Usually a pair of underwires is incorporated into a brassiere or similar undergarment to provide shape and support to a pair of breast cups. However, in some forms the underwire may comprise a single underwire frame which traverses both breast cups.

An underwire generally comprises a continuous planar piece of wire. Although underwires are typically formed from material providing a certain degree of flexibility to allow the underwire to assume the general shape of the wearer's figure by virtue of the forces applied to the underwire when the back strap or wings of the brassiere are fastened around the wearer's torso, the substantially rigid nature of the material used to form the underwire results in a less than even pressure being exerted on the wearer's figure causing discomfort. Efforts to make the underwire more flexible to improve comfort levels result in a corresponding loss of stabilizing function.

It would be desirable to maximise the wearer's comfort whilst at the same time providing enhanced support by providing an improved support structure.

Other objects and advantages of the invention will become apparent to those of ordinary skill in the art having reference to the following specification together with its drawings.

SUMMARY OF THE INVENTION

According to an aspect of the present invention, there is provided a support structure for placement in a lower periphery of a breast cup for a brassiere comprising:

a support component shaped to follow the curve of at least the underside of a wearer's breast, the support component including a first region formed by a first polymer material and a second region formed by a second polymer material, wherein the first polymer material is harder than the second polymer.

The support component of the present invention provides an alternative to a conventional underwire and offers enhanced breast support and comfort to the wearer.

The first region of the support component may comprise a core of the support component with the second region surrounding the first region.

The first region may have at least an area of thickness which is greater than a thickness of the second region. Preferably, the thickness tapers from a maximum thickness at the core of the first region to a minimum thickness at the periphery of the second region.

The first region may be formed from polypropylene.

The second region may be formed from thermoplastic rubber.

In a preferred embodiment, the hardness of the first region is Shore A 95 and hardness of the second region is Shore A 70.

In another preferred embodiment, the Rockwell hardness of the first region falls within a range of 85R to 125R, while the Rockwell hardness of the second region falls within a range of 55R to 85R.

According to another aspect of the present invention, there is provided a brassiere comprising:

two breast cups each including:

an outer panel including an outer fabric layer;

an inner panel including an inner fabric layer to be worn against a wearer's skin;

a support component positioned between the outer panel and the inner panel, the support component being shaped to follow the curve of at least the underside of a wearer's breast;

an intermediate bridging region extending between an inner region of the two breast cups; and a back strap extending from an outer region of one of the two breast cups to an outer region of the other of the two breast cups to secure the brassiere to a torso of the wearer;

wherein the support component includes a first region formed by a first polymer material and a second region formed by a second polymer material, wherein the first polymer material is harder than the second polymer.

The first region may comprise a core of the support component and the second region surrounds the first region.

The first region may have at least an area of thickness which is greater than a thickness of the second region. Preferably, the thickness tapers from a maximum thickness at a core of the first region to a minimum thickness at a periphery of the second region.

The first region may be formed from polypropylene.

The second region may be formed from thermoplastic rubber.

In a preferred embodiment, the hardness of the first region is Shore A 95 and hardness of the second region is Shore A 70.

In another preferred embodiment, the Rockwell hardness of the first region falls within a range of 85R to 125R, while the Rockwell hardness of the second region falls within a range of 55R to 85R.

According to yet another aspect of the present invention, there is provided a method of making a breast cup for a brassiere, the method comprising the following steps:

forming an outer panel including an outer fabric layer;

forming an inner panel including an inner fabric layer to be worn against a wearer's skin;

positioning a support component between the outer panel and the inner panel so as to lie in a lower region of the breast cup, the support component being shaped to follow the curve of at least the underside of a wearer's breast;

laminating the outer panel to the inner panel with the support component there between;

trimming the laminated panels to define a breast cup;

wherein the support component includes a first region formed by a first polymer material and a second region formed by a second polymer material, wherein the first polymer material is harder than the second polymer.

The steps of forming the outer and inner panels may include laminating the respective fabric layers with a foam layer to form laminated panels.

The step of forming the inner and outer panels may further include moulding the laminated panels to form a breast cup shape.

In one embodiment, the step of moulding the laminated fabric and foam layers comprises the following steps:

performing a first moulding step on the outer panel or inner panel to form a breast cup shape; and positioning the support component on the moulded panel or inner so as to lie in a lower region of the breast cup;

placing a corresponding inner panel or outer panel over the moulded panel and support component to form a layered assembly; and performing a second moulding step on the layered assembly in a second moulding step to form the breast cup shape; and trimming the moulded layered assembly to define a breast cup.

BRIEF DESCRIPTION OF THE DRAWINGS

It will be convenient to hereinafter describe the invention in greater detail by reference to the accompanying figures which facilitate understanding of this invention. The particularity of the figures and the related description is not to be understood as superseding the generality of the broad identification of the invention as given in the attached claims.

DETAILED DESCRIPTION

Figure 1:
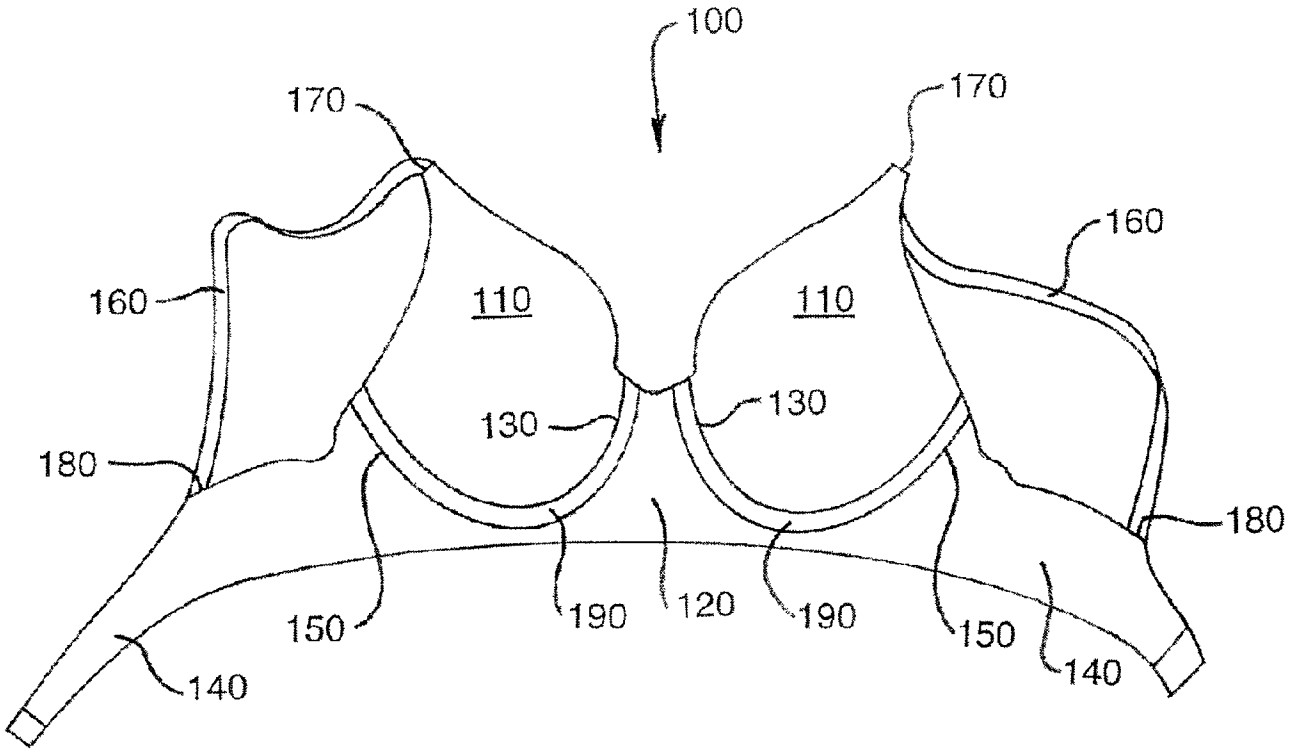
FIG 1 (PRIOR ART)
FIG. 1 is a schematic drawing of a typical brassiere.

Referring firstly to FIG. 1, there is shown a typical brassiere 100 comprising of a pair of breast cups 110 intended to cover and support the breasts of the wearer, a connector 120 securing together the inner edges of the cups 130 at the wearer's cleavage, and at least one strap-like back or wing 140 that extends from the outer edges 150 of the breast cups around the back of the wearer. The brassiere 100 may further include shoulder straps 160 that extend from upper edges 170 of the breast cups 110 over the shoulders of the wearer to attachment points 180 on the back wing or wings 140 crossing the wearers back. The brassiere 100 further includes a pair of substantially U-shaped underwires to shape and support the lower periphery 190 of each breast cup 110.

Figure 2A:
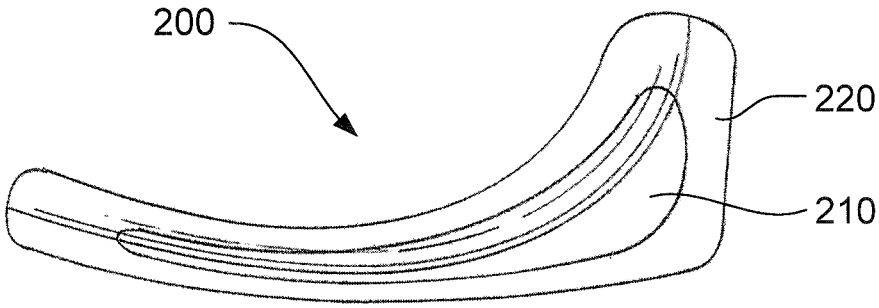
FIG. 2A is a top down view showing an inner surface of a support component according to an embodiment of the present invention.
Figure 2B:
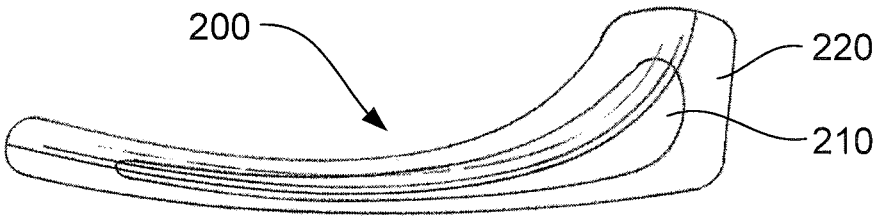
FIG. 2B is a top down view showing an upper edge of the support component of FIG. 2A.

Referring now to FIG. 2A there is shown a support structure for placement in proximity to a lower periphery 190 of a breast cup 110 in a brassiere 100. A support component 200 is shaped to follow the curve of a wearer's breast. The support component 200 provides an alternate and improved support structure to a conventional underwire and offers enhanced breast support and comfort to the wearer.

The support component 200 includes a first region 210, at least part of which constitutes the core of the support component. The first region 210 is formed by a first polymer material. A second region 220 surrounds the first region and is formed by a second polymer material. The first polymer material and the second polymer materials are selected to exhibit characteristics such as being light weight, resiliently deformable and being inexpensive to produce. For instance, the first polymer material and second polymer material may be a suitable type of plastic. However, the first polymer material used to form the first region 210 or core of the support component 200 must be harder than the second polymer material used to form the surrounding second region 220.

The hardness of the first polymer material must be sufficient to enable the first region 210 of the support component 200 to provide support to the wearer's breast, i.e. as a replacement for a conventional metallic underwire. The hardness of the second polymer material forming the second region 220 of the support component 200 is such as to provide a relatively smooth transition in hardness from the first region 210 of the support component 200 to the laminated fabric and/or foam layers forming the breast cup. Without a gradual decline in rigidity of the support component 200 and the difference between the hardness of the first region 210 formed from the first polymer material and the "soft" fabric and/or foam components of the breast cup, the support component would be both visibly and tactilely evident within the breast cup which is an undesirable result.

In addition to the difference in hardness between the first polymer material and the second polymer material used to form the first region 210 and the second region 220 of the support component 200 respectively, a variation in the thickness of the first region and second region of the support component may also exist. Since the thickness of a materials impacts on the hardness of the material, the first region 210 is thicker than the second region 220. In one embodiment, the variation in thickness is achieved by coating the inner surface of the first region 210, i.e. the side which is closest to the wearer's skin during use, with the second polymer material. This also provides a cushioning effect since the material closer to the wearer's skin (see FIG. 6B) is of a lesser hardness than the core of the support component 200. The variation in thickness further facilitates the smooth transition between the support component 200 and the "soft" fabric and/or foam components forming the breast cup. Preferably, the thickness tapers from a maximum thickness at the core of the first region 210 to a minimum thickness at the periphery of the second region 220.

The first polymer material used to form the first region 210 of the support component 200 is preferably a plastic such as polypropylene or an impact resistant polypropylene copolymer made by blending polypropylene with ethylene-propylene-rubber. The hardness of the first material may be regulated by adding calcium carbonate ($CaCO_3$). The less hard second polymer material used to form the second region 220 of the support component 200 is preferably a thermoplastic rubber or similar. In an embodiment, a preferred hardness of the first polymer material is Shore A 95, while a preferred hardness of the second polymer material is Shore A 70. In another embodiment, the Rockwell hardness of the first polymer material falls within a preferred range of 85R to 125R, while the Rockwell hardness of the second polymer material falls within a preferred range of 55R to 85R.

Figure 3:
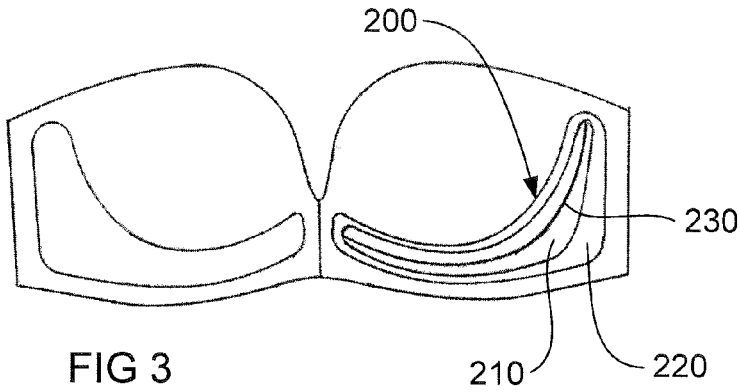
FIG. 3 is a schematic front on view of a brassiere showing the position of the support components within each breast cup.
Figure 4:
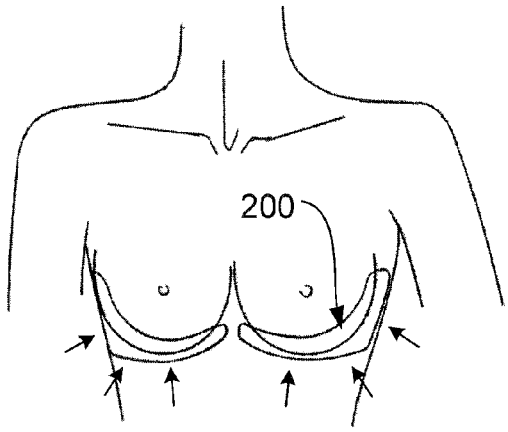
FIG. 4 is a schematic front on view showing the position of the support component of FIG. 2A when fitted to the underside of a wearer's breast.

Referring now to FIGS. 3 and 4 there is shown how the shape of the support component 200 is generally derived in two dimensions. The first region 210 or the "hard core region" of the support component 200 is shaped to conform to the region of the wearer's figure that would ordinarily be in contact with a conventional underwire 230, i.e. at least the underside of a wearer's breast where some rigidity is required to support the breast tissue. The first region 210 of the support component 200 is then surrounded by second region 220 of reduced hardness to facilitate a smooth transition from the support component to the soft breast cup components. The support component 200 is shaped in three dimensions to conform closely to the three dimensional figure of a wearer. Accordingly, the support component 200 is curved about at least two perpendicular axes to provide a comfortable fit for the wearer.

Preferably, as shown in FIGS. 3 and 4, the support component 200 also extends upwards (relatively to the orientation of the wearer) to provide support to the outer periphery of the wearer's breast resulting in an overall "push up" and "push in" effect as depicted by the arrows in FIG. 4.

It is an advantage of the support component that it provides enhanced breast support when compared with a conventional underwire since the support provided by the support component of the present invention extends further towards the centre of the breast cup as compared to a conventional underwire which only provides support at the periphery of the breast cup. Moreover, the support component offers enhanced comfort since the total surface area in contact with the wearer's breast is greater resulting in a broader region of contact and a more even distribution of pressure than the narrow contact of a conventional underwire.

Figure 5B:
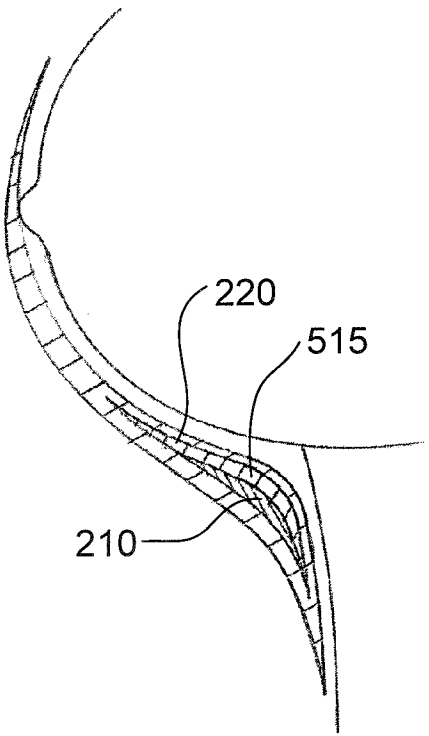
FIG. 5B is a cross sectional view through the support component of FIG. 5A.
Figure 5A:
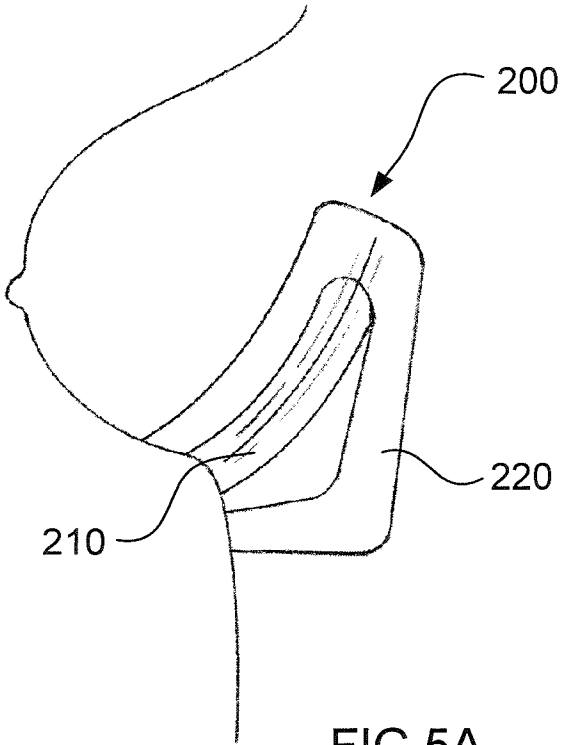
FIG. 5A is a side on view showing the position of the support component of FIG. 2A when fitted to the underside of a wearer's breast.

Referring now to FIG. 5A there is shown a side on view of the support component 200 fitted to a wearer's breast which gives some further indication of its shape in three dimensions. A cross section through this view as shown in FIG. 5B shows the alternate embodiment of the support component 200 wherein the inner surface 515 of the first region 210 is coated with the second polymer material used to form the second region 220. Given that the second polymer material has reduced hardness relative to the first polymer material, the coated surface should be worn closest to the wearer's skin in use.

This variant of the support component can be produced by a two step injection moulding process wherein the first polymer material is injected first followed by the second polymer material. Alternatively, a single step injection moulding process wherein both the first polymer material and the second polymer material are injected at the same time may be used.

In a preferred embodiment, an outer fabric layer is laminated to an outer foam layer to form an outer panel, and an inner fabric layer is laminated to an inner foam layer to form an inner panel. The support component is then placed between the outer panel and the inner panel at a position which will correspond generally to the lower periphery of the breast cup. However, it is to be understood that the support component of the present invention could also be used in a breast cup with only one or no foam layers, i.e. wherein the outer panel and/or the inner panel comprise only a fabric layer.

Generally, a breast cup as described above containing the support component 200 of the present invention is manufactured through a two step moulding process. During the first moulding step, the outer fabric layer and outer foam layer forming the outer panel (or the inner fabric layer and inner foam layer forming the inner panel as the case may be) is moulded, e.g. heat pressed to assume the desired three dimensional breast cup shape. The support component is then placed in position and the inner panel (or the outer panel as the case may be) is placed on top. The foam layers have a pre-applied adhesive so that the inner and outer panels are laminated together in the second moulding step, e.g. using a heat press, to form a moulded breast cup incorporating the support component. The moulded breast cup is then trimmed to produce the desired shape.

Figure 6:
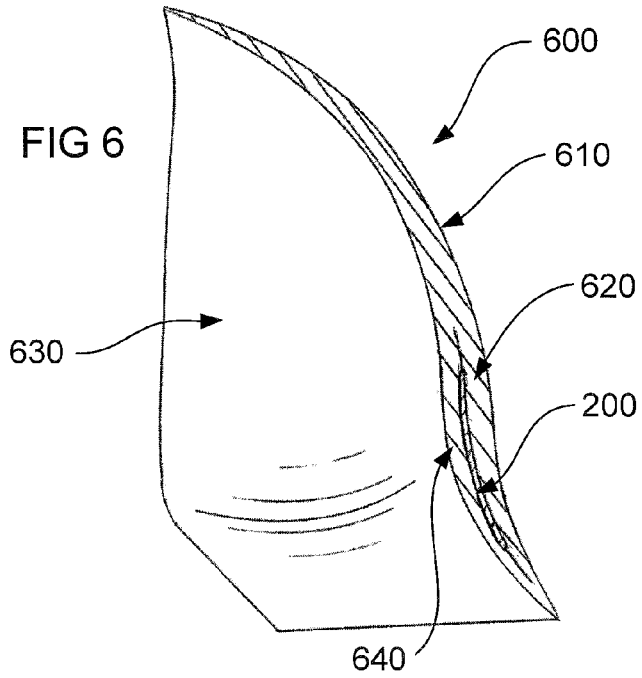
FIG. 6 is an isometric view of a moulded breast cup incorporating the support structure of the present invention.

Now referring to FIG. 6 there is shown a cross section through a moulded breast cup 600, formed in accordance with the method described. The moulded breast cup 600 includes the outer fabric layer 610 and outer foam layer 620 forming the outer panel, and the inner fabric layer 630 and inner foam layer 640 forming the inner panel with the support component 200 sandwiched there between.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

The invention claimed is:

1. A support structure configured for placement in a lower periphery of a breast cup of a brassiere comprising:

a support component having a continuous curved body extending from a first end to a second end, the curved body having a convex exterior surface and a concave exterior surface opposite the convex exterior surface, the convex and the concave exterior surfaces being joined along first and second edges, the convex exterior surface being positioned to be closer to the wearer's body and the concave surface being positioned to be further from the wearer's body when the support component is installed in the breast cup, and each exterior surface extending along a respective curved line that extends from the first end to the second end, the convex exterior surface following the curve of at least the underside of the wearer's breast, the support component including a first region formed by a first polymer material and a second region formed by a second polymer material, wherein the first polymer material is harder than the second polymer, and the first region is thicker than the second region.

2. A support structure for placement in a lower periphery of a breast cup for a brassiere according to claim 1, wherein the first region comprises a core of the support component and the second region surrounds the first region.

3. A support structure for placement in a lower periphery of a breast cup for a brassiere according to claim 1, wherein the first region has at least an area which is thicker than the second region.

4. A support structure for placement in a lower periphery of a breast cup for a brassiere according to claim 3, wherein thickness of the support component tapers from a maximum thickness at the core of the first region to a minimum thickness at periphery of the second region.

5. A support structure for placement in a lower periphery of a breast cup for a brassiere according to claim 1, wherein the first region is formed from polypropylene.

6. A support structure for placement in a lower periphery of a breast cup for a brassiere according to claim 1, wherein the second region is formed from thermoplastic rubber.

7. A support structure for placement in a lower periphery of a breast cup for a brassiere according to claim 1, wherein the hardness of the first region is Shore A 95.

8. A support structure for placement in a lower periphery of a breast cup for a brassiere according to claim 1, wherein the hardness of the second region is Shore A 70.

9. A support structure for placement in a lower periphery of a breast cup for a brassiere according to claim 1, wherein the Rockwell hardness of the first region falls within a range of 85R to 125R.

10. A support structure for placement in a lower periphery of a breast cup for a brassiere according to claim 1, wherein the Rockwell hardness of the second region falls within a range of 55R to 85R.

11. A brassiere comprising:

two breast cups each including:

an outer panel including an outer fabric layer;

an inner panel including an inner fabric layer to be worn against a wearer's skin;

a support component positioned between the outer panel and the inner panel, the support component having a continuous curved body extending from a first end to a second end, the curved body having a convex exterior surface and a concave exterior surface opposite the convex exterior surface, the convex and the concave exterior surfaces being joined along first and second edges, the convex exterior surface being positioned to be closer to the wearer's body and the concave surface being positioned to be further from the wearer's body when the support component is installed in the breast cup, and each exterior surface extending along a respective curved line that extends from the first end to the second end, the convex exterior surface following the curve of at least the underside of the wearer's breast;

an intermediate bridging region extending between an inner region of the two breast cups; and a back strap extending from an outer region of one of the two breast cups to an outer region of the other of the two breast cups to secure the brassiere to a torso of the wearer;

wherein the support component includes a first region formed by a first polymer material and a second region formed by a second polymer material, wherein the first polymer material is harder than the second polymer and wherein the first region is thicker than the second region.

12. A brassiere according to claim 11, wherein the first region comprises a core of the support component and the second region surrounds the first region.

13. A brassiere according to claim 11, wherein the first region has at least an area of thickness which is greater than a thickness of the second region.

14. A brassiere according to claim 13, wherein the thickness tapers from a maximum thickness at a core of the first region to a minimum thickness at a periphery of the second region.

15. A brassiere according to claim 11, wherein the first region is formed from polypropylene.

16. A brassiere according to claim 11, wherein the second region is formed from thermoplastic rubber.

17. A brassiere according to claim 11, wherein the hardness of the first region is Shore A 95.

18. A brassiere according to claim 11, wherein the hardness of the second region is Shore A 70.

19. A brassiere according to claim 11, wherein the Rockwell hardness of the first region falls within a range of 85R to 125R.

20. A brassiere according to claim 11, wherein the Rockwell hardness of the second region falls within a range of 55R to 85R.

21. A method of making a breast cup for a brassiere, the method comprising the following steps:

forming an outer panel including an outer fabric layer;

forming an inner panel including an inner fabric layer to be worn against a wearer's skin;

positioning a support component between the outer panel and the inner panel so as to lie in a lower region of the breast cup, the support component having a continuous curved body extending from a first end to a second end, the curved body having a convex exterior surface and a concave exterior surface opposite the convex exterior surface, the convex and the concave exterior surfaces being joined along first and second edges, the convex exterior surface being positioned to be closer to the wearer's body and the concave surface being positioned to be further from the wearer's body when the support component is installed in the breast cup, and each exterior surface extending along a respective curved line that extends from the first end to the second end, the convex exterior surface following the curve of at least the underside of the wearer's breast;

laminating the outer panel to the inner panel with the support component there between; trimming the laminated panels to define a breast cup;

wherein the support component includes a first region formed by a first polymer material and a second region formed by a second polymer material, wherein the first polymer material is harder than the second polymer and wherein the first region is thicker than the second region.

22. A method of making a breast cup for a brassiere according to claim 21, wherein the steps of forming the outer and inner panels includes laminating the respective fabric layers with a foam layer to form laminated panels.

23. A method of making a breast cup for a brassiere according to claim 22, wherein the step of forming the inner and outer panels further includes molding the laminated panels to form a breast cup shape.

24. A method of making a breast cup according to claim 23, wherein the step of molding the laminated fabric and foam layers comprises the following steps:

performing a first molding step on the outer panel or inner panel to form a breast cup shape; and positioning the support component on the molded panel or inner so as to lie in a lower region of the breast cup;

placing a corresponding inner panel or outer panel over the molded panel and support component to form a layered assembly; and performing a second molding step on the layered assembly in a second molding step to form the breast cup shape; and trimming the molded layered assembly to define a breast cup.

* * * * *